US005101234A

United States Patent [19]

Suzuki et al.

[11] Patent Number: 5,101,234

[45] Date of Patent: Mar. 31, 1992

[54] ELECTROPHOTOGRAPHIC PRINTING MECHANISM

[75] Inventors: Yuichiro Suzuki; Makoto Kurosawa; Masaaki Koseki; Yasushi Hashimoto, all of Ibaraki, Japan

[73] Assignee: Hitachi Koki Co., Ltd., Tokyo, Japan

[21] Appl. No.: 669,887

[22] Filed: Mar. 14, 1991

[30] Foreign Application Priority Data

Mar. 16, 1990 [JP] Japan ..... 2-67871

[51] Int. Cl.[5] ..... G03G 15/00

[52] U.S. Cl. ..... 355/213

[58] Field of Search ..... 355/211, 212, 213, 215

[56] References Cited

FOREIGN PATENT DOCUMENTS 2643908 2/1978 Fed. Rep. of Germany ..... 355/213

OTHER PUBLICATIONS

IBM Technical Disclosure Bulletin, vol. 18, No. 7, Dec. 75, Bolan, "Lock Mechanism for Drum Gap Seal".

*Primary Examiner*—Joan H. Pendegrass
*Assistant Examiner*—P. Stanzione
*Attorney, Agent, or Firm*—Cushman, Darby & Cushman

[57] ABSTRACT

In an electrophotographic printing mechanism in which a photosensitive drum mechanism having a photosensitive drum and a drum cap is turned to electrostatically form an image on the photosensitive material wound on the drum, the drum cap is provided with a switch which is operated by a switch control unit, so that when the mechanism is stopped for urgent work, the operator is protected from being struck by electricity touching the drum cap.

3 Claims, 3 Drawing Sheets

ELECTROPHOTOGRAPHIC PRINTING MECHANISM

BACKGROUND OF THE INVENTION

1. Field of Invention

This invention relates to an electrophotographic printing machine, and more particularly to a drum cap grounding mechanism for a drum cap charging mechanism in the drum cap, which drum cap forms a photosensitive drum mechanism together with a photosensitive drum in the electrophotographic printing machine.

2. Description of Related Art

The photosensitive drum mechanism of a conventional electrophotographic printing machine is as shown in FIG. 2 (PRIOR ART).

In FIG. 2 (PRIOR ART), various parts of the figure are designated by reference numerals 1–5: a web-shaped photosensitive material 1 (a belt-shaped thin film about 90 μm in thickness); a photosensitive drum 2 on which the photosensitive material is wound; a take-up roll 3, arranged inside the photosensitive drum, for winding the photosensitive material; a supply roll 4 also arranged inside the photosensitive drum, for supplying the photosensitive material when necessary; and a metal drum cap 5 provided for the photosensitive drum, to seal the interior of the photosensitive drum.

FIG. 3 (PRIOR ART) is an explanatory diagram, drawn partly as a sectional diagram, for a description of the function of the conventional photosensitive drum mechanism. In FIG. 3 (PRIOR ART), various parts are designated by reference numerals 1–10: reference numerals 1–5 designating the same parts designated in FIG. 2 (PRIOR ART), plus, a drum cap charging mechanism 6, a photosensitive material charging mechanism 7; a developing mechanism 8; and an exposing mechanism 10.

A conventional printing operation for the photosensitive material 1 will be described with reference to FIG. 3 (PRIOR ART).

First, the photosensitive material 1 is supplied from the supply roll 4 and led out of the drum 2 through a first gap between the drum and the drum cap 5. The photosensitive material thus protruded is wound counterclockwise on the drum about one turn. The front end portion of the photosensitive material thus wound is inserted into the drum through a second gap between the drum and the drum cap, and wound on the takeup roll 3 until the photosensitive material is stretched tight. Thus, the photosensitive material is fixedly wound on the drum.

In this condition, the photosensitive drum is turned counterclockwise. Therefore, the photosensitive material wound on the drum is first charged by the photosensitive material charging mechanism 7, and then exposed by the exposing mechanism 10, and finally developed by the developing mechanism 8. Thus, the printing operation for the photosensitive material is accomplished.

The image developed by the developing mechanism is erased every revolution of the drum, and a new printing image is formed. However, when the number of revolutions of the drum reaches about 10,000, the photosensitive material will have deteriorated in photosensitivity, and therefore it is necessary to replace it with new photosensitive material. The replacement is carried out by using the supply roll and the takeup roll in the above-described manner.

The drum cap is metal, as described above, and its function is to prevent the entrance of foreign materials such as toner, developing agent and paper powder into the drum during rotation.

During the rotation of the photosensitive drum mechanism, the drum cap is charged to a high potential by the photosensitive material charging mechanism. If the potential of the drum cap is decreased, then foreign materials such as toner are liable to stick to the drum cap. In order to overcome this difficulty, the drum cap is provided with the above-mentioned drum cap charging mechanism so that, when the drum cap, thus charged, passes through the developing mechanism, the potential of the drum cap is maintained equal to the photosensitive material surface potential.

As described above, when the photosensitive drum mechanism is in operation, the drum cap is held at a high potential by the drum cap charging mechanism provided for it.

Conventionally, the drum cap at high potential is placed in natural discharge when the photosensitive drum mechanism stops rotating. Therefore, after the printing operation is suspended, the drum cap stays at a high potential for a time. This results in a problem when maintenance work needs to be performed after the printing operation is suspended, because the operator may receive an electric shock when touching the drum cap.

SUMMARY OF THE INVENTION

Accordingly, an object of this invention is to eliminate the above-described problem accompanying a conventional photosensitive drum mechanism.

More specifically, an object of the invention is to provide an electrophotographic printing mechanism in which the drum cap of the photosensitive drum mechanism is grounded by a simple switching means to protect the operator from receiving an electric shock, when the drum is stopped for urgent maintenance work.

The foregoing object and other objects of the invention have been achieved in an electrophotographic printing mechanism, in which a photosensitive drum mechanism comprising a photosensitive drum, on which a belt-shaped photosensitive material is wound; a supply roll for supplying the photosensitive material; a takeup roll for winding the photosensitive material, the supply roll-and takeup roll being accommodated in the photosensitive drum; and a drum cap closing an opening which is formed in the cylindrical wall of the photosensitive drum for supplying the photosensitive material from the supply roll and winding the photosensitive material on the takeup roll. The photosensitive material is passed through a charging mechanism, an exposing mechanism and a developing mechanism arranged along the outer cylindrical wall of the photosensitive drum mechanism so that an image is formed on the photosensitive material. According to the invention, the drum cap of the photosensitive drum mechanism is provided with a drum cap grounding mechanism.

In the printing operation, the photosensitive drum mechanism is charged, and, accordingly, the drum cap, a part of the photosensitive drum mechanism, is also charged. More specifically, in order to prevent the sticking of toner to the drum cap during the printing operation, the drum cap is held at high potential by means of a drum cap charging mechanism. Hence, the provision of the drum cap grounding mechanism for the drum cap protects the operator from receiving a shock when touching the drum cap after the printing operation is suspended for some urgent reason. Thus, the drum cap grounding mechanism ensures safety in the printing operation.

The nature, principle and utility of the invention will become more apparent from the following detailed description when read in conjunction with the accompanying drawings.

DETAILED DESCRIPTION OF THE PREFERRED EMBODIMENTS

An electrophotographic printing mechanism embodying this invention will be described with reference to FIG. 1.

Figure 1:
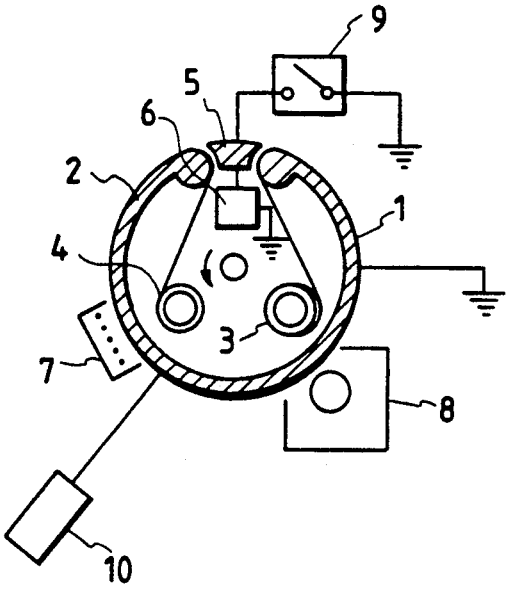
FIG. 1 is an explanatory diagram, partly drawn as a sectional diagram, showing a photosensitive drum mechanism according to this invention, and other mechanisms related thereto.
Figure 3:
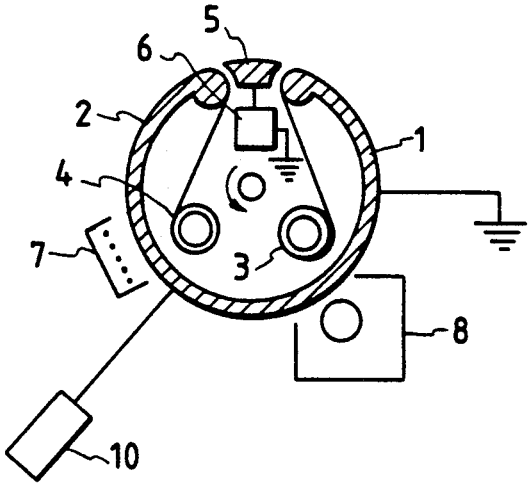
FIG. 3 (PRIOR ART) is an explanatory diagram, partly drawn as a sectional diagram, showing the conventional photosensitive drum mechanism, and other mechanisms related thereto.
Figure 2:
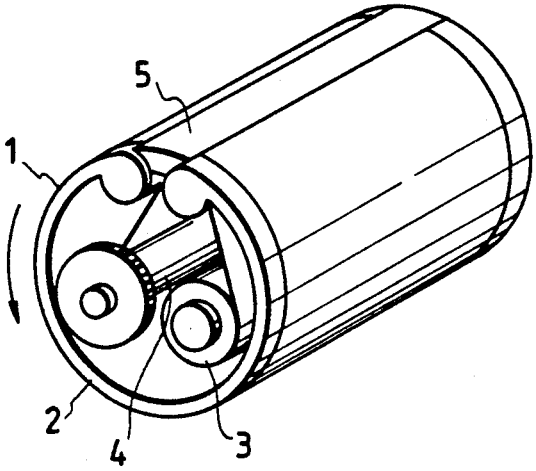
FIG. 2 (PRIOR ART) is a perspective view showing a conventional photosensitive drum mechanism.

In FIG. 1, the following parts of an electrophotographic printing mechanism are designated as follows: a chargeable photosensitive material 1; a drum 2; a takeup roll 3; a supply roll 4; a drum cap 5; a drum cap charging mechanism 6; a photosensitive material charging mechanism 7; a developing mechanism 8; a switch 9; and an exposing mechanism 10.

The photosensitive drum mechanism functions and operates in-the same manner as the above-described conventional one.

The drum cap is provided with a switch 9 which is operated by a switching control unit, so that the drum cap which is normally held at high potential so as to prevent the sticking of foreign materials such as toner can be quickly discharged when the photosensitive drum mechanism is stopped for urgent work.

Figure 5:
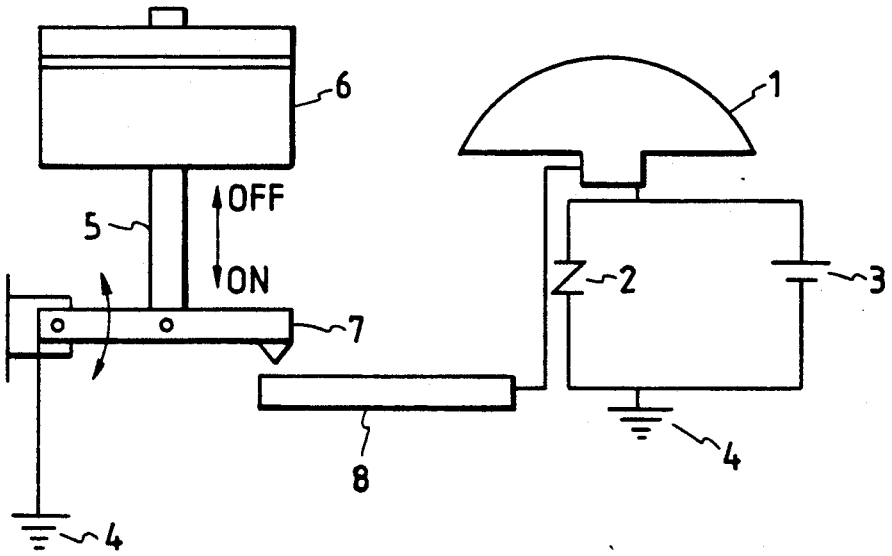
FIG. 5 is a diagram showing the switch mechanism for grounding the drum cap as it relates to the drum cap charging mechanism of FIG. 4.

More specifically, the drum cap grounding switch 9, as shown in FIG. 5, is so controlled by the control unit that immediately after the printing operation is suspended, the switch is turned on for a short time to ground the drum cap by discharging the potential. In other words, when the printing operation is suspended, the drum cap is grounded, and therefore the operator touching the drum cap will not receive an electric shock.

Figure 4:
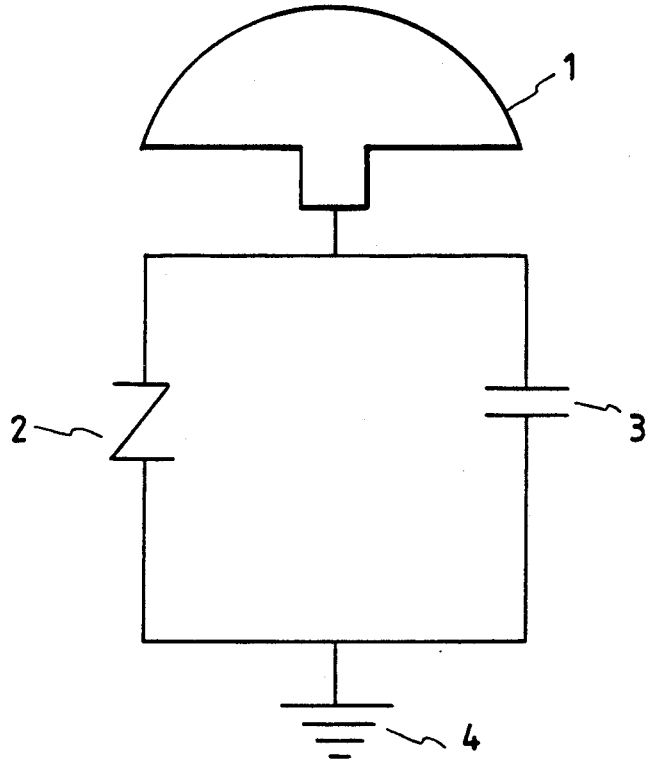
FIG. 4 (PRIOR ART) is a diagram showing the drum cap charging mechanism for the drum cap.

During the operation of the printing machine, the drum cap is charged to 500–700 V by a conventional electrical circuit, as shown in FIG. 4 (PRIOR ART).

FIG. 5 shows in detail the switch mechanism for grounding the drum cap. When a solenoid 6 is in the OFF position, the ground terminal 7 of the drum cap grounding mechanism is positioned away from the high voltage terminal 8 of the drum cap charging mechanism. A plunger 5 adjacent to the solenoid pushes the ground terminal against the high-voltage terminal when the solenoid switches to the ON position. When the ground terminal contacts the high voltage terminal, the potential on the drum cap is immediately discharged.

Figure 6:
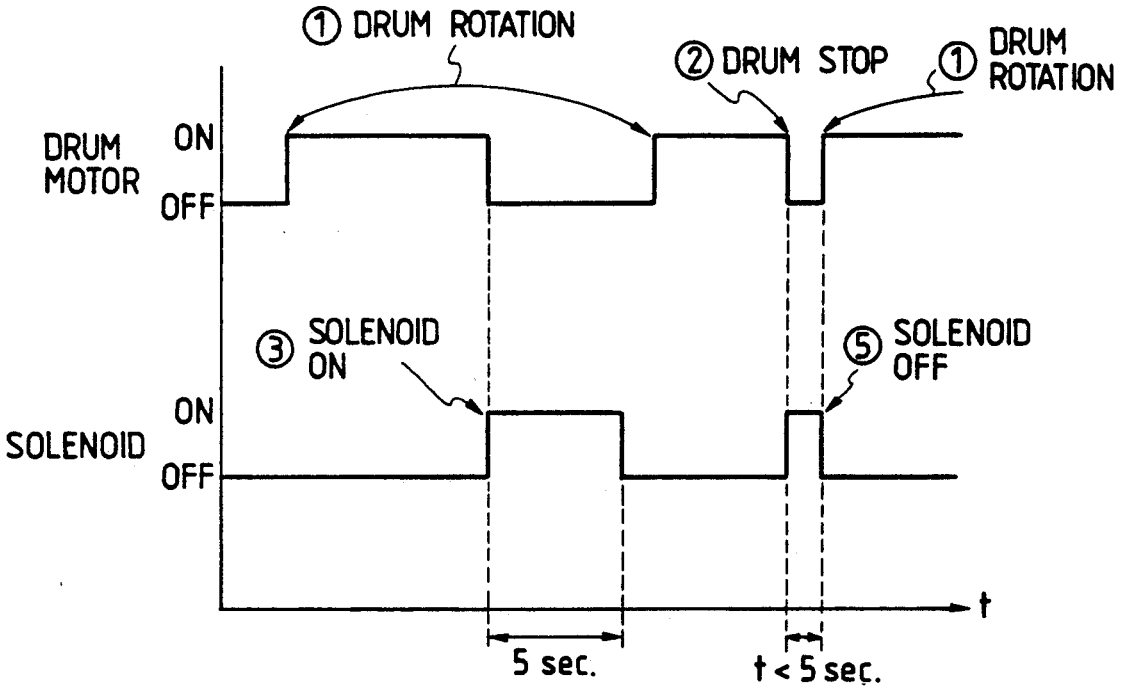
FIG. 6 is an operational timing diagram correlating the operation of the solenoid with the operation of the drum.

FIG. 6 shows an operational timing chart which correlates the ON-OFF position of the solenoid with whether the-drum is rotating or stopped.

According to FIG. 6, when the drum is rotating, the solenoid is in the OFF position. As soon as the drum stops rotating, the solenoid switches to the ON position for about 5 seconds. If before 5 seconds, the drum begins to rotate again, the solenoid immediately switches to the OFF position again. This is necessary so that the drum can be immediately charged as soon as the drum begins to rotate. Otherwise, if the drum cap is not immediately recharged, toner becomes attached to the drum cap.

What is claimed is:

1. An electrophotographic printing apparatus comprising:

a drum, wherein a belt-shaped photosensitive material is wound around an outer surface of a cylindrical wall of the drum;

a supply roll and a takeup roll for said photosensitive material, said supply roll and said takeup roll being positioned inside said drum; and a drum cap covering an opening in the cylindrical wall of said drum, wherein said drum cap comprises a drum cap charging mechanism and a drum cap grounding mechanism.

2. An electrophotographic printing apparatus according to claim 1 wherein said drum cap grounding mechanism comprises:

a solenoid having an ON position and an OFF position;

a plunger located adjacent to the solenoid, wherein the plunger moves away from the solenoid when the solenoid is in the ON position;

a ground terminal connected to said plunger; and a high voltage terminal connected to said drum cap charging mechanism;

wherein, as the plunger moves away from the solenoid, the ground terminal contacts a high voltage terminal of the drum cap charging mechanism, thus discharging potential on the drum cap.

3. An electrophotographic printing apparatus, according to claim 2, wherein the solenoid is in the OFF position when the drum is rotating, switches to the ON position for a short time when the drum stops rotating, and immediately switches to the OFF position when the drum starts rotating again.

* * * * *